US012492455B2

(12) United States Patent
Takenaka

(10) Patent No.: US 12,492,455 B2
(45) **Date of Patent: *Dec. 9, 2025**

(54) SINTERED MEMBER, AND METHOD FOR MANUFACTURING SINTERED MEMBER

(71) Applicant: SUMITOMO ELECTRIC SINTERED ALLOY, LTD., Okayama (JP)

(72) Inventor: Chihiro Takenaka, Okayama (JP)

(73) Assignee: SUMITOMO ELECTRIC SINTERED ALLOY, LTD., Okayama (JP)

( * ) Notice: Subject to any disclaimer, the term of this patent is extended or adjusted under 35 U.S.C. 154(b) by 545 days.

This patent is subject to a terminal disclaimer.

(21) Appl. No.: 17/633,663

(22) PCT Filed: Sep. 17, 2020

(86) PCT No.: PCT/JP2020/035338

§ 371 (c)(1),
(2) Date: Feb. 8, 2022

(87) PCT Pub. No.: WO2021/065552

PCT Pub. Date: Apr. 8, 2021

(65) Prior Publication Data

US 2022/0290278 A1 Sep. 15, 2022

(30) Foreign Application Priority Data

Oct. 3, 2019 (JP) ..... 2019-182667

(51) Int. Cl.
*C22C 38/44* (2006.01)
*B22F 1/00* (2022.01)
(Continued)

(52) U.S. Cl.
CPC ..... *C22C 38/44* (2013.01); *B22F 1/00* (2013.01); *C21D 6/004* (2013.01);
(Continued)

(58) Field of Classification Search
CPC . C22C 38/44; C22C 33/0257; C22C 33/0264; C22C 38/00; B22F 1/00;
(Continued)

(56) References Cited

U.S. PATENT DOCUMENTS 6,302,937 B1 * 10/2001 Hayashi ..... C22C 38/36 75/231
2005/0109157 A1 * 5/2005 Toyoshima ..... C22C 38/08 75/255

(Continued)

FOREIGN PATENT DOCUMENTS

JP 2004-323939 11/2004
JP 2005-336608 12/2005

(Continued)

OTHER PUBLICATIONS

JP-2017179588-A, machine translation (Year: 2017).*

*Primary Examiner* — John A Hevey
(74) *Attorney, Agent, or Firm* — IPUSA, PLLC

(57) ABSTRACT

A sintered member including Fe as a main component thereof, includes a composition including Ni, Cr, Mo, and C, and a remainder including Fe and inevitable impurities, and a mixed-phase composition including a martensite phase and a residual austenite phase, wherein a Ni-content occupying the sintered member is larger than 2 mass % and less than or equal to 6 mass %, when a total content of elements included in the sintered member is regarded as 100 mass %, and a variation width of a Vickers hardness from a surface to a predetermined depth of the sintered member is less than or equal to 100 HV.

8 Claims, 5 Drawing Sheets

(51) Int. Cl.
*C21D 6/00* (2006.01)
*C22C 33/02* (2006.01)

(52) U.S. Cl.
CPC .... *C22C 33/0257* (2013.01); *C21D 2211/001* (2013.01); *C21D 2211/008* (2013.01)

(58) Field of Classification Search
CPC .... B22F 2998/10; B22F 3/12; B22F 2301/35; C21D 6/004; C21D 2211/001; C21D 2211/008
See application file for complete search history.

(56) References Cited

U.S. PATENT DOCUMENTS

| | | | | |
|---|---|---|---|---|
| 2008/0025866 | A1 | 1/2008 | Kondoh et al. | |
| 2015/0352638 | A1* | 12/2015 | Steiner | C22C 33/0257 418/229 |
| 2016/0215820 | A1 | 7/2016 | Sugai et al. | |
| 2020/0208244 | A1 | 7/2020 | Egashira et al. | |

FOREIGN PATENT DOCUMENTS

| | | | |
|---|---|---|---|
| JP | 2006-274359 | | 10/2006 |
| JP | 2015-148249 | | 8/2015 |
| JP | 2016-121367 | | 7/2016 |
| JP | 2017179588 | A * | 10/2017 |
| WO | 2019/021935 | | 1/2019 |

* cited by examiner

SINTERED MEMBER, AND METHOD FOR MANUFACTURING SINTERED MEMBER

TECHNICAL FIELD

The present disclosure relates to sintered members, and methods for manufacturing sintered members.

This application is based upon and claims priority to Japanese Patent Application No. 2019-182667, filed on Oct. 3, 2019, the entire contents of which are incorporated herein by reference.

BACKGROUND ART

Patent Document 1 describes a Fe—Ni—Cr—Mo—C-based sintering material in which a Ni-content is 0.5 mass % to 2.0 mass.

PRIOR ART DOCUMENTS

Patent Document

Patent Document 1: Japanese Laid-Open Patent Publication No. 2016-121367

DISCLOSURE OF THE INVENTION

A sintered member according to the present disclosure is a sintered member including Fe as a main component thereof, and including

- a composition including Ni, Cr, Mo, and C, and a remainder including Fe and inevitable impurities; and
- a mixed-phase composition including a martensite phase and a residual austenite phase, wherein
- a Ni-content occupying the sintered member is larger than 2 mass % and less than or equal to 6 mass %, when a total content of elements included in the sintered member is regarded as 100 mass %, and
- a variation width of a Vickers hardness from a surface to a predetermined depth of the sintered member is less than or equal to 100 HV.

A method for manufacturing a sintered member according to the present disclosure includes

- a process of preparing a powder of raw material including a powder of an iron-based alloy, a Ni powder, and a C powder;
- a process of pressure molding the powder of raw material to form a green compact; and
- a process of sintering the green compact, wherein
- the powder of iron-based alloy in the preparing process has a composition including Cr and Mo, and a remainder including Fe and inevitable impurities,
- a content of the Ni powder occupying the power of raw material is larger than or equal to 2 mass % and smaller than or equal to 6 mass %, when an entirety of the powder of raw material is regarded as 100 mass %, and
- a cooling rate in a cooling process of the sintering process is higher than or equal to 1° C./sec.

MODE OF CARRYING OUT THE INVENTION

Figure 1:
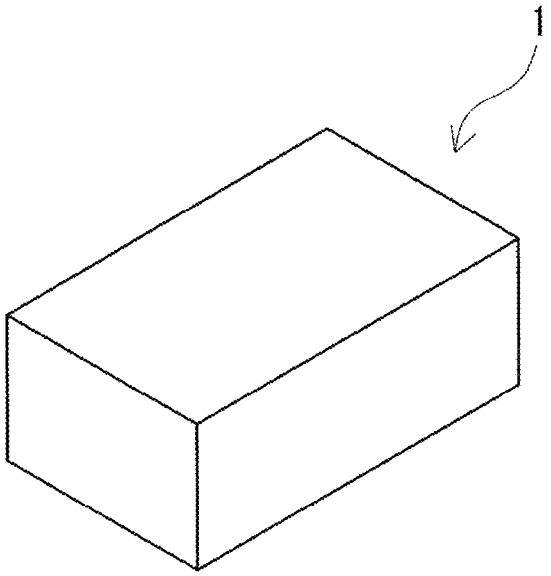
FIG. 1 is a perspective view illustrating a sintered member according to one embodiment.

Problems to be Solved by the Present Disclosure

There are demands to develop high-hardness and high-toughness sintered members.

Accordingly, one object of the present disclosure is to provide a sintered member having both a high hardness and a high toughness.

Further, another object of the present disclosure is to provide a method for manufacturing a sintered member, which can manufacture a sintered member having both a high hardness and a high toughness.

Effects of the Present Disclosure

The sintered member according to the present disclosure has both the high hardness and the high toughness.

The method for manufacturing the sintered member according to the present disclosure can manufacture a sintered member having both the high hardness and the high toughness.

MODE FOR CARRYING OUT THE INVENTION

Description of Embodiments of the Present Disclosure

The present inventor diligently studied methods for manufacturing a sintered member having a high hardness and a high toughness which are further increase. As a result, it was found that a sintered member having a high hardness and toughness can be obtained by satisfying both (a) and (b) below.

(a) Instead of preparing a powder of an iron-based alloy including a large amount of Ni as an alloy component, a powder of an iron-based alloy, and a powder independent from the powder of iron-based alloy and including a large amount of Ni, are prepared.

(b) Rapid cooling is performed in a cooling process of a sintering process.

The present disclosure is based on the above findings. Embodiments of the present disclosure will first be described in the following.

(1) A sintered member according to one embodiment of the present disclosure is a sintered member including Fe as a main component thereof, and including a composition including Ni, Cr, Mo, and C, and a remainder including Fe and inevitable impurities; and a mixed-phase composition including a martensite phase and a residual austenite phase, wherein a Ni-content occupying the sintered member is larger than 2 mass % and less than or equal to 6 mass, when a total content of elements included in the sintered member is regarded as 100 mass %, and a variation width of a Vickers hardness from a surface to a predetermined depth of the sintered member is less than or equal to 100 NV.

The sintered member described above has both a high hardness and a high toughness. The high hardness is obtained because of the composition described above, the Ni-content that is not excessively large, and a martensite phase having a high hardness, for example. The high toughness is obtained because the Ni-content is large, and a residual austenite phase having a high toughness, for example. In addition, the sintered member described above also has a uniform hardness from a surface to a predetermined depth of the sintered member. This is because the variation width of the Vickers hardness described above is small.

(2) According to one embodiment of the sintered member described above, a Cr-content is larger than or equal to 2 mass % and smaller than or equal to 4 mass %, a Mo-content is large than or equal to 0.2 mass % and smaller than or equal to 0.9 mass %, and a C-content is larger than or equal to 0.2 mass % and smaller than or equal to 1.0 mass %, for example.

The sintered member has a high hardness. This is because the contents of each of the elements described above satisfies the range described above, as will be described later in detail.

(3) According to one embodiment of the sintered member described above, an area ratio of the residual austenite phase in an arbitrary cross section of the sintered member is greater than or equal to 5%, for example.

The sintered member described above has an excellent toughness. This is because to the area ratio of the high-toughness residual austenite phase is high.

(4) According to one embodiment of the sintered member described above, a stress amplitude withstanding a reverse bend test performed $10^7$ times during a rotating bending fatigue test is greater than or equal to 420 MPa, for example.

The sintered member described above has an excellent toughness. This is because an excellent bending fatigue strength is obtained due to the high stress amplitude described above.

(5) A method for manufacturing a sintered member according to one embodiment of the present disclosure includes a process of preparing a powder of raw material including a powder of an iron-based alloy, a Ni powder, and a C powder;

a process of pressure molding the powder of raw material to form a green compact; and a process of sintering the green compact, wherein the powder of iron-based alloy in the preparing process has a composition including Cr and Mo, and a remainder including Fe and inevitable impurities, a content of the Ni powder occupying the power of raw material is larger than or equal to 2 mass % and smaller than or equal to 6 mass %, when an entirety of the powder of raw material is regarded as 100 mass %, and a cooling rate in a cooling process of the sintering process is higher than or equal to 1° C./sec.

The method for manufacturing the sintered member can manufacture a sintered member having both a high hardness and a high toughness. This is because the method for manufacturing the sintered member can form a mixed-phase composition including the high-hardness martensite phase and the high-toughness residual austenite phase, by satisfying both (a) and (b) below.

(a) Prepare the powder of raw material including a powder of an iron-based alloy, a large amount of Ni powder independent from the powder of iron-based alloy, and C powder.

(b) Rapid cooling is performed in a cooling process of the sintering process.

In addition, by satisfying (b) above, the variation width of the Vickers hardness from the surface to the predetermined depth of the sintered member can be reduced. For this reason, the hardness from the surface to the predetermined depth of the sintered member can be made uniform.

Details of Embodiments of the Present Disclosure

Embodiments of the present disclosure are described in detail below.

Embodiments

[Sintered Member]

A sintered member 1 according to one embodiment will be described, by referring to FIG. 1, FIG. 2, FIG. 3A, FIG. 3B, FIG. 4A, and FIG. 4B. The sintered member 1 includes Fe (iron) as a main component thereof. The sintered member 1 has a composition including Ni (nickel), Cr (chromium), Mo (molybdenum), and C (carbon), and a remainder formed from Fe and inevitable impurities. One of the features of the sintered member 1 includes the following requirements (a) through (c).

(a) Has a high Ni-content.

(b) Has a specific composition.

(c) Is subjected to a sinter hardening process.

A detailed description is given below.

[Composition]

(Ni) Ni increases the toughness of the sintered member 1. Ni also contributes to increasing the hardness of the sintered member 1, because a hardenability can be improved during a manufacturing process of the sintered member 1. Hereinafter, the manufacturing process of the sintered member 1 may simply be referred to as a manufacturing process. The Ni-content is larger than 2 mass % and smaller than or equal to 6 mass %. The sintered member 1 has an excellent toughness when the Ni-content is larger than 2 mass %. This is because of the Ni-content is large. When the Ni-content is large, a portion of the Ni is alloyed with Fe, but a remainder of the Ni is not alloyed and exists as pure Ni. This portion existing as the pure Ni contributes to improvement of the toughness. The sintered member 1 has an excellent hardness when the Ni-content is smaller than or equal to 6 mass %. This is because deterioration of the hardness caused by excessively high Ni-content can be reduced. For this reason, when the Ni-content satisfies the range described above, the sintered member 1 can have both a high hardness and a high toughness. The Ni-content is more preferably larger than or equal to 2.5 mass % and smaller than or equal to 5.5 mass %, and particularly preferably larger than or equal to 3 mass % and smaller than or equal to 5 mass %. The Ni-content refers to a Ni-content occupying the sintered member 1 when a total content of elements included in the sintered member 1 is regarded as 100 mass %. The same applies to contents of Cr, Mo, and C, which will be described later.

(Cr) Cr increases the hardness of the sintered member 1. This is because Cr can increase the hardenability during the manufacturing process. A Cr-content is preferably larger than or equal to 2 mass % and smaller than or equal to 4 mass %, for example. The sintered member 1 has an excellent hardness when the Cr-content is larger than or equal to 2 mass %. The deterioration of the toughness of the sintered member 1 can be reduced when the Cr-content is smaller than or equal to 4 mass %. The Cr-content is more preferably larger than or equal to 2.2 mass % and smaller than or equal to 3.8 mass %, and particularly preferably larger than or equal to 2.5 mass % and smaller than or equal to 3.5 mass %.

(Mo) Mo increases the hardness of the sintered member 1. This is because Mo can increase the hardenability during the manufacturing process. A Mo-content is preferably larger than or equal to 0.2 mass % and smaller than or equal to 0.9 mass %. The sintered member 1 has an excellent hardness when the Mo-content is larger than or equal to 0.2 mass %. The deterioration of the toughness of the sintered member 1 can be reduced when the Mo-content is smaller than or equal to 0.9 mass %. The Mo-content is more preferably larger than or equal to 0.3 mass % and smaller than or equal to 0.8 mass %, and particularly preferably larger than or equal to 0.4 mass % and smaller than or equal to 0.7 mass %.

(C) C improves the hardness of the sintered member 1. C easily generates a liquid phase of Fe—C during the manufacturing process. This liquid phase of Fe—C tends to round corners of holes. For this reason, the sintered member 1 has fewer sharp corner portions of the holes that may cause deterioration of the hardness. Hence, the hardness of the sintered member 1 easily becomes high. A C-content is preferably larger than or equal to 0.2 mass % and smaller than or equal to 1.0 mass %, for example. The sintered member 1 has a high hardness when the C-content is larger than or equal to 0.2 mass %. This is because the liquid phase of Fe—C is sufficiently generated and the corner portions of the holes can easily and effectively be rounded during the manufacturing process. The sintered member 1 has an excellent dimensional accuracy when the C-content is larger than or equal to 1.0 mass %. This is because it is easy to reduce excessive generation of the liquid phase of Fe—C during the manufacturing process. The C-content is more preferably larger than or equal to 0.3 mass % and smaller than or equal to 0.95 mass % and particularly preferably larger than or equal to 0.4 mass % and smaller than or equal to 0.9 mass %.

A composition of the sintered member 1 can be determined by component analysis using ICP Optical Emission Spectrometry (Inductively Coupled Plasma Optical Emission Spectrometry: ICP-OES) or the like.

[Composition]

The composition of sintered member 1 is a mixed-phase composition of the martensite phase and the residual austenite phase (FIG. 3A, FIG. 3B, FIG. 4A, and FIG. 4B). FIG. 3A, FIG. 3B, FIG. 4A, and FIG. 4B are microphotographs of a cross section of sintered member 1, as will be described later in detail. In each of these figures, a white portion at a tip end of an arrow indicates the residual austenite phase, and a surrounding portion of the residual austenite phase is the martensite phase. The sintered member 1 has a high hardness by having the martensite phase. The sintered member 1 has a high toughness by having the residual austenite phase.

The area ratio of the residual austenite phase is preferably greater than or equal to 5%, for example. In this case, the sintered member 1 has an excellent toughness because the area ratio of the high-toughness residual austenite phase is high. The area ratio of the residual austenite phase is preferably less than or equal to 50%, for example. In this case, the area ratio of the residual austenite phase does not become excessively large. That is, the area ratio of the martensite phase easily becomes large. Hence, the sintered member 1 has a high hardness and a high toughness. The area ratio of the residual austenite phase is more preferably greater than or equal to 10% and less than or equal to 45%, and particularly preferably greater than or equal to 15% and less than or equal to 40%. The area ratio of the residual austenite phase refers to a ratio of a total area of the residual austenite phase with respect to a total area of the microphotograph at the cross section of the sintered member 1, as will be described later in detail.

[Properties]

(Hardness)

The sintered member 1 has a high hardness. This is because the sintered member 1 has a high Vickers hardness, and a variation width of the Vickers hardness (circular marks indicated in the graph of FIG. 2) is small. Details of the graph of FIG. 2 will be described later. The Vickers hardness of the sintered member 1 is greater than or equal to 615 HV. The variation width of the Vickers hardness of the sintered member 1 is less than or equal to 100 HV. For this reason, the sintered member 1 has a high hardness that is uniform, from the surface to the predetermined depth. Because the variation width of the Vickers hardness of the sintered member 1 is small, the sintered member 1 is subjected to a sinter hardening process which rapidly cools in the cooling process of the sintering process. No hardening and tempering is performed after the sintering, because the sintered member 1 is subjected to the sinter hardening process. A variation width of the Vickers hardness of the sintered member 1 which is not subjected to the sinter hardening process, and instead subjected to the hardening and tempering after the sintering, is greater than 100 HV, for example.

Further, the Vickers hardness of the sintered member 1 is more preferably greater than or equal to 620 HV, and particularly preferably greater than or equal to 625 HV. The variation width of the Vickers hardness described above is more preferably less than or equal to 75 HV, and particularly preferably less than or equal to 50 HV. The Vickers hardness of the sintered member 1 is an average of the Vickers hardness measured at a plurality of points between the surface of the sintered member 1 and the predetermined depth in the cross section of the sintered member 1, as will be described later in detail. The variation width of the Vickers hardness of the sintered member 1 refers to a difference between a maximum value and a minimum value of the Vickers hardness measured between the surface and the predetermined depth in the cross section of the sintered member 1, as will be described later in detail.

(Toughness)

The sintered member 1 has a high toughness. This is because a stress amplitude withstanding a reverse bend test performed $10^7$ times during an Ono-type rotating bending fatigue test, which will be described later in detail, is large, and an excellent bending fatigue strength is obtained. The stress amplitude withstanding the reverse bend test performed $10^7$ times is preferably greater than or equal to 420 MPa. Further, the stress amplitude withstanding the reverse bend test performed $10^7$ times is more preferably greater than or equal to 423 MPa, and particularly preferably greater than or equal to 425 MPa.

[Applications]

The sintered member 1 according to the embodiment may suitably utilized in various kinds of components for general structure. The components for general structure include mechanical components or the like, for example. Examples of the mechanical components include cam components of electromagnetic couplings, planetary carriers, sprockets, rotors, gears, rings, flanges, pulleys, bearings, or the like, for example.

[Functions and Effects]

The sintered member 1 according to the present embodiment can have both a high hardness and a high toughness. This is because the sintered member 1 has an excellent toughness due to the large Ni-content, and can reduce deterioration of the hardness by not including an excessively large Ni-content. It is also because the sintered member 1 has the mixed-phase composition of the high-hardness martensite phase and the high-toughness residual austenite phase. In addition, the sintered member 1 has a uniform hardness from the surface to the predetermined depth. This is because the sintered member 1 has a small variation width of the Vickers hardness.

[Method for Manufacturing Sintering Member]

A method for manufacturing the sintered member according to the present embodiment includes a process of preparing a powder of raw material, a process of making a green compact, and a process of sintering the green compact. One of the features of the method for manufacturing the sintered member is to satisfy both the following requirements (a) and (b).

(a) In the preparing process, a powder including a powder of an iron-based alloy, a large amount of Ni powder independent from the powder of iron-based alloy, and C powder, is prepared as the powder of the raw material.

(b) In the sintering process, rapid cooling is performed in a cooling process of the sintering process.

In the following, each of the process will be described in order.

[Preparing Process]

This process prepares the powder of raw material including the powder of iron-based alloy, the Ni powder, and the C powder.

(Powder of Iron-Based Alloy)

The powder of iron-based alloy has a composition including Cr and Mo, and a remainder including Fe and inevitable impurities. The Cr-content and the Mo-content in the iron-based alloy are maintained after the sintering process which will be described later. That is, the Cr-content and the Mo-content of the iron-based alloy are maintained in the sintered member 1 described above. As described above, the Cr-content in the iron-based alloy is preferably larger than or equal to 2 mass % and smaller than or equal to 4 mass %, and more preferably larger than or equal to 2.2 mass % and smaller than or equal to 3.8 mass %, and particularly preferably larger than 2.5 mass % and smaller than or equal to 3.5 mass %, for example. In addition, as described above, the Mo-content in the iron-based alloy is preferably larger than or equal to 0.2 mass % and smaller than or equal to 0.9 mass %, more preferably larger than or equal to 0.3 mass % and smaller than or equal to 0.8 mass %, and particularly preferably larger than or equal to 0.4 mass % and smaller than or equal to 0.7 mass %, for example. The reason for the setting the Cr-content and the Mo-content in these ranges is as described above. The Cr-content and the Mo-content refer to the contents of Cr and Mo in the iron-based alloy, respectively, when a total content of elements included in the iron-based alloy is regarded as 100 mass %.

An average particle diameter of the powder of iron-based alloy is greater than or equal to 50 μm and less than or equal to 150 μm, for example. The powder of iron-based alloy having the average particle diameter within the range described above is easy to handle, and can easily be pressure molded. The powder of iron-based alloy having the average particle diameter greater than or equal to 50 μm can more easily secure flow. The powder of iron-based alloy powder having the average particle diameter less than or equal to 150 μm enables the sintered member 1 with a dense composition to be easily obtained. The average particle diameter of the powder of iron-based alloy is more preferably greater than or equal to 55 μm and less than or equal to 100 μm, for example. The "average particle diameter" refers to the particle diameter (D50) at which a cumulative volume in a volume particle diameter distribution measured by a laser diffraction type particle size distribution measuring device is 50%. The same similarly applies to the average particle diameters of the Ni powder and the C powder, which will be described later.

(Ni Powder)

The Ni powder includes pure Ni powder, for example. The Ni powder content is maintained even after the sintering process which will be described later. That is, the Ni powder content is maintained in the sintered member 1 described above. As described above, the Ni powder content is preferably larger than 2 mass % and less than or equal to 6 mass %, more preferably larger than or equal to 2.5 mass % and less than or equal to 5.5 mass %, and particularly preferably larger than or equal to 3 mass % and less than or equal to 5 mass %. By including a large Ni powder content, a portion of the Ni can be alloyed with Fe in the sintering process, and a remainder of the Ni exist as pure Ni without being alloyed. In addition, it is possible to form a mixed-phase composition of the martensite phase and the residual austenite phase. For this reason, it is easy to manufacture the sintered member 1 having an excellent toughness. Moreover, by not including an excessively large Ni powder content, it is possible to easily reduce the deterioration of the hardness. Hence, when the Ni powder content satisfies the range described above, the sintered member 1 having both the high strength and the high toughness can be manufactured. The Ni powder content refers to the Ni powder content occupying the powder of raw material, when an entirety of the powder of raw material is regarded as 100 mass %.

The average particle diameter of the Ni powder affects a distribution state of the residual austenite phase. The average particle diameter of the Ni powder is greater than or equal to 1 μm and less than or equal to 40 μm, for example. The Ni powder having the average particle diameter less than or equal to 40 μm can easily distribute the residual austenite phase uniformly. The Ni powder having the average particle diameter greater than or equal to 1 μm is easy to handle, and can improve workability of the manufacturing operation. The average particle diameter of the Ni powder is more preferably greater than or equal to 1 μm and less than or equal to 30 μm, and particularly preferably greater than or equal to 1 μm and less than or equal to 20 μm, for example.

(C Powder)

The C powder assumes a liquid phase of Fe—C during a temperature raising process of the sintering process, and rounds the corners of the holes in the sintered member 1 to improve the hardness of the sintered member 1. The C powder content, similar to the Ni powder content or the like, is maintained even after the sintering process, which will be described later. That is, the C powder content in the powder of raw material is maintained in the sintered member 1 described above. As described above, the C powder content is preferably larger or equal to 0.2 mass % and less than or equal to 1.0 mass %, more preferably larger than or equal to 0.3 mass % and less than or equal to 0.95 mass %, and particularly preferably greater than or equal to 0.4 mass % and less than or equal to 0.9 mass %.

The average particle diameter of the C powder is preferably made smaller than the average particle diameter of the powder of iron-based alloy. Because the C powder having the average particle diameter smaller than the powder of iron-based alloy can easily be dispersed uniformly in the powder of iron-based alloy, and the alloying can progress easily. The average particle diameter of the C powder is greater than or equal to 1 μm and less than or equal to 30 μm, and preferably greater than or equal to 10 μm and less than or equal to 25 μm, for example. From a viewpoint of generating the liquid phase of Fe—C, the average particle diameter of the C powder is preferably large, but if the average particle diameter is too large, a time it takes for the liquid phase to occur becomes long, thereby making the holes too large and generating defects.

(Others)

The powder of raw material powder may include a lubricant. The lubricant improves lubricity during molding of the powder of raw material, and improves compactibility. Examples of the lubricant include higher fatty acids, metal stones, fatty acid amides, higher fatty acid amides, or the like, for example. Known lubricants may be utilized as such lubricants. Existing form of the lubricant is not particularly limited, and may be in solid form, powder form, liquid form, or the like. At least one of such lubricants may be used independently, or a combination of such lubricants may be used, as the lubricant. When the powder of raw material is regarded as being 100 mass %, a lubricant content in the powder of raw material is larger than or equal to 0.1 mass % and less than or equal to 2.0 mass %, preferably larger than or equal to 0.3 mass % and less than or equal to 1.5 mass %, and particularly preferably larger than or equal to 0.5 mass % and less than or equal to 1.0 mass %, for example.

The powder of raw material may include an organic binder. A known organic binder may be utilized. When the powder of raw material is regarded as being 100 mass %, a content of the organic binder is less than or equal to 0.1 mass %, for example. When the content of the organic binder is less than or equal to 0.1 mass %, a ratio of metal powder included in the compact can be made large, thereby making it easier to obtain a green compact. When no organic binder is included, the green compact does not need to be cleaned in a subsequent process.

[Process of Making Green Compact]

In this process, the powder of raw material pressure molded to make the green compact. A shape of the green compact that is made be selected, as appropriate, and may include a columnar shape, a cylindrical shape, or the like, for example. When making the green compact, a die capable of uniaxial pressing may be utilized, for example. The uniaxial pressing refers to press molding along an axial direction of the columnar shape or the cylindrical shape.

The higher the molding pressure is, the higher the density of the green compact becomes, thereby enabling the sintered member 1 to have a high density and a high hardness. A molding pressure is greater than or equal to 400 MPa, preferably greater than or equal to 500 MPa, and particularly preferably greater than or equal to 600 MPa, for example. An upper limit of the molding pressure is not particularly limited, and may be 2000 MPa, preferably 1000 MPa, and particularly preferably 900 MPa, for example.

This green compact may be subjected to a cutting process, as appropriate. A known cutting may be utilized for the cutting process.

[Sintering Process]

This process sinters the green compact. By sintering the green compact, the sintered member 1, in which particles of the powder of raw material are bonded together, is obtained. A continuous sintering furnace may be utilized for the sintering of the green compact. The continuous sintering furnace includes a sintering furnace, and a rapid cooling chamber on a downstream side and continuous with the sintering furnace.

Sintering conditions may be selected, as appropriate, according to the composition of the powder of raw material. A sintering temperature may be higher than or equal to 1050° C. and lower than or equal to 1400° C., and preferably higher than or equal to 1100° C. and lower than or equal to 1300° C., for example. A sintering time may be longer or equal to 10 minutes and shorter than or equal to 150 minutes, and preferably longer than or equal to 15 minutes and shorter than or equal to 60 minutes, for example. Known sintering conditions are applicable to the sintering conditions.

A cooling rate in the cooling process during the sintering process is greater than or equal to 1° C./sec, for example. When the cooling rate is greater than or equal to 1° C./sec, the sintered member 1 is rapidly cooled. For this reason, a mixed phase composition of the martensite phase and the residual austenite phase is easily formed. Thus, the sintered member 1 having excellent hardness and toughness is manufactured. In particular, the sintered member 1 having a high hardness is manufactured, because the larger the C content is, the easier it is to form the martensitic phase. In addition, the sintered member having a high toughness is easily manufactured, because the larger the amount of the Ni powder is, the easier it is to form the residual austenite phase. Further, when the sintered member 1 is rapidly cooled, the sintered member 1 having a small variation width of the Vickers hardness from the surface to the predetermined depth is easily manufactured. More particularly, the sintered member 1 having the variation width of the Vickers hardness, which is less than or equal to 100 HV, is manufactured. The cooling rate is more preferably greater than or equal to 2° C./sec, and particularly preferably greater than or equal to 5° C./sec. An upper limit of the cooling rate is 1000° C./sec, preferably 500° C./sec, and particularly preferably 200° C./sec, for example.

A cooling method includes spraying a cooling gas onto the sintered member 1, for example. Examples of the kinds of cooling gas include inert gases, such as nitrogen gas, argon gas, or the like, for example.

[Other Processes]

The method for manufacturing the sintered member may include other processes, such as a finishing process.

(Finishing Process)

This process adjusts the dimensions of the sintered member 1 to design dimensions. The finishing process may include sizing, polishing the surface of the sintered member 1, or the like, for example. In particular, a polishing process can easily reduce a surface roughness of the sintered member 1.

[Applications]

The method for manufacturing the sintered member according to one embodiment may be suitably employed in the manufacture of the various kinds of components for general structure described above.

[Functions and Effects]

The method for manufacturing the sintered member according to the present embodiment can manufacture the sintered member 1 having a high hardness and a high toughness. The method for manufacturing the sintered member prepares the powder of raw material including a large content of Ni powder in a preparing process, and performs rapid cooling in a cooling process of a sintering process. For this reason, the method for manufacturing the sintered member can cause pure Ni with an excellent toughness, that is not alloyed, to be present. In addition, the method for manufacturing the sintered member can form a mixed-phase composition of the high-hardness martensite phase and the high-toughness residual austenite phase. The method for manufacturing the sintered member prepares the powder of raw material in which the content of the Ni powder is not excessively large in the preparing process, and performs rapid cooling in the cooling process of the sintering process. Hence, the method for manufacturing the sintered member can prevent excessive formation of the high-toughness residual austenite phase. Further, the method for manufacturing the sintered member can manufacture the sintered member 1 having a small variation width of the Vickers hardness from the surface to the predetermined depth.

Test Examples

In the test examples, the hardness and the toughness of the sintered member were evaluated.

[Sample No. 1, Sample No. 2]

A sample No. 1 and a sample No. 2 of the sintered member were made through a process of preparing the powder of raw material, a process of making the green compact, and a process of sintering the green compact, similar to the method for manufacturing the sintered member described above.

[Preparing Process]

A mixed powder including a powder of iron-based alloy, a Ni powder, and a C powder was prepared, as the powder of raw material.

The powder of iron-based alloy includes a plurality of iron alloy particles including Cr and Mo, and a remainder formed from Fe and inevitable impurities. A Cr-content and a Mo-content occupying the iron-based alloy are illustrated in Table 1. That is, the Cr-content in the iron-based alloy is 3.0 mass %, and the Mo-content the iron-based alloy is 0.5 mass %. In Table 1, "-" indicates that a corresponding element is not included.

Table 1 illustrates the contents of the Ni powder and the C powder occupying the powder of raw material. In the sample No. 1, the content of the Ni powder is 3 mass %, the content of the C powder is 0.65 mass %, and a remainder is the content of the Fe powder. In the sample No. 2, the content of the Ni powder is 4 mass %, the content of the C powder is 0.75 mass %, and the remainder is the Fe powder.

[Process of Making Green Compact]

A green compact was made by pressure molding the powder of raw material. The molding pressure was 700 MPa.

[Sintering Process]

The green compact was sintered to make a sintered member. The green compact was sintered using a continuous sintering furnace having a sintering furnace, and a rapid cooling chamber on a downstream side and continuous with the sintering furnace. The sintering conditions included a sintering temperature of 1300° C., and a sintering time of 15 minutes.

(Cooling Process)

In the cooling process of the sintering process, a sinter hardening process was performed to rapidly cool the sintered member. More particularly, the cooling rate is 3° C./sec for an ambient temperature from the start of the cooling up to 300° C. This cooling was performed by spraying nitrogen gas, as a coolant gas, onto the sintered member.

[Sample No. 101, Sample No. 102]

A sample No. 101 and a sample No. 102 of the sintered member were prepared in a manner similar to the sample No. 1, except for the content of the Ni powder and the content of the C powder occupying the prepared powder of raw material. More particularly, in the sample No. 101, the content of the Ni powder occupying the powder of raw material is 1 mass %, and the content of the C powder occupying the powder of raw material is 0.7 mass %. In the sample No. 102, the content of the Ni powder occupying the powder of raw material powder is 2 mass %, and the content of the C powder occupying the powder of raw material is 0.7 mass %.

[Sample No. 110]

A sample No. 110 of the sintered member was prepared in a manner similar to the sample No. 2, except for the following points (a) through (e).

(a) The composition of the prepared powder of iron-based alloy does not include Cr, and includes Ni and Cu.
(b) The powder of raw material does not include Ni powder.
(c) The content of the C powder occupying the powder of raw material is different.
(d) In the cooling process of the sintering process, a slow cooling process was performed instead of rapid cooling.
(e) After the sintering process, hardening and tempering were performed.

The powder of iron-based alloy includes a plurality of iron alloy particles including Cu, Mo, and Ni, and a remainder formed from Fe and inevitable impurities. A Cu-content in the iron-based alloy is 1.5 mass %. A Mo-content in the iron-based alloy is 0.5 mass %. A Ni-content in the iron base alloy is 4 mass %. In the sample No. 110, the content of the C powder occupying the powder of raw material is 0.5 mass %, and the content of the Fe powder is the remainder.

In the cooling process of the sintering process, the sintered member was subjected to slow cooling instead of rapid cooling. The cooling rate is approximately 0.5° C./sec.

[Measurement of Apparent Density]

An apparent density (g/cm$^3$) of each sample of the sintered member was measured by utilizing the Archimedes' principle. The apparent density was determined from "(dry weight of sintered member)/{(dry weight of sintered member)−(weight in water of oil-impregnated material of sintered member)}×(density of water)". The weight in water of the oil-impregnated member of the sintered member refers to the weight of the member when the sintered member immersed in oil and oil-impregnated is immersed in water. A number N is assumed to be three. An average of measured results for three sintered members was regarded as the apparent density of each sample of the sintered member. The results are illustrated in Table 1.

[Evaluation of Hardness]

The hardness of the sintered member was evaluated by determining the Vickers hardness of the sintered member, and the variation width of the Vickers hardness from the surface to the predetermined depth of the sintered member.

The Vickers hardness was measured in conformance with JIS Z 2244 (2009). A test piece was cut out from the sintered member. The shape of the test piece was rectangular. The size of the test piece was 55 mm×10 mm×thickness of 10 mm. The test piece was cut out so that one surface of the test piece along a thickness direction is formed by the surface of the sintered member.

The Vickers hardness was measured at eleven locations between a surface and a predetermined depth of the test piece in the cross section of the test piece. The surface of the test piece is the one surface of the test piece along the thickness direction described above. The predetermined depth is 5.0 mm along a direction perpendicular with respect to the surface of the test piece. The measurement locations include one point 0.1 mm from the surface, and ten points spaced at a pitch of 0.5 mm from the surface. The number N is assumed to be three.

An average of the Vickers hardness at all measurement points of the three test pieces was regarded as the Vickers hardness of the sintered member. A difference between a maximum value and a minimum value of the averages of the Vickers hardness at each of the measurement points of the three test pieces was regarded as the variation width of the Vickers hardness of the sintered member. The results are illustrated in Table 1.

Figure 2:
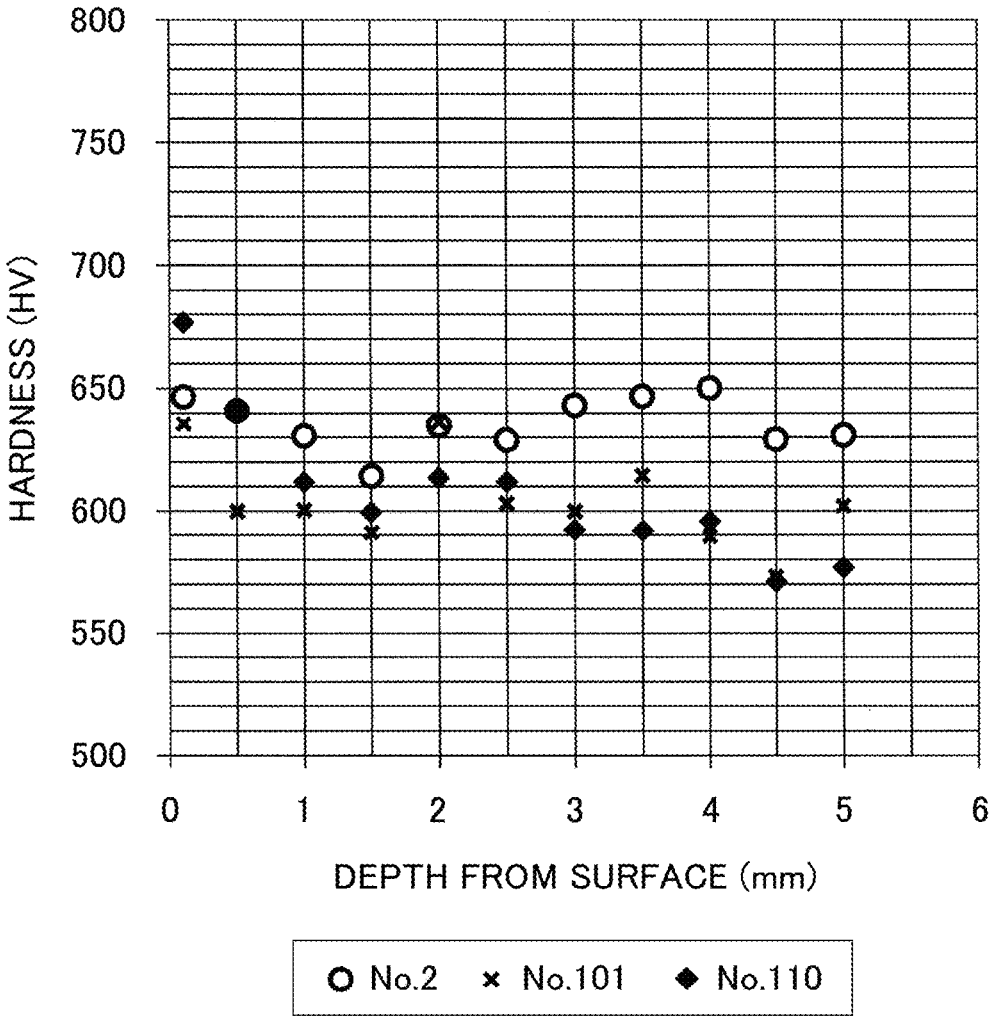
FIG. 2 is a graph illustrating Vickers hardness of a sintered member of a sample No. 2, the Vickers hardness of a sintered member of a sample No. 101, and the Vickers hardness of a sintered member of a sample No. 110 according to one embodiment of the sintered member.

The average Vickers hardness at each of the measurement points of the three test pieces of the sintered member of sample No. 2, sample No. 101, and sample No. 110 are indicated in FIG. 2 by circular marks, cross marks, and black rhombic marks, respectively, as representative examples. In the graph illustrated in FIG. 2, an abscissa indicates the depth (mm) from the surface, and the ordinate indicates the Vickers hardness (HV).

[Evaluation of Toughness]

The toughness of the sintered member was evaluated by measuring the stress amplitude by the Ono-type rotating bending fatigue test Ono rotating bending fatigue test.

The Ono-type rotating bending fatigue test was performed using a testing machine FTO-100 manufactured by Tokyo Koki Testing Machine Co., Ltd. in conformance with JIS Z 2274 (1978). The test piece was cut from the sintered member. The test piece was prepared in conformance with the No. 1 test piece of JIS Z 2274 (1978). More particularly, the shape of the test piece was a dumbbell shape. This test piece has a pair of large diameter portions, and a small diameter portion. Each large diameter portion is provided at each of two ends along an axial direction of the test piece. Each large diameter portion has a cylindrical shape. Each large diameter portion has a uniform diameter along an axial direction of the large diameter part. The small diameter portion is provided between the two large diameter portions. The two large diameter portions and the small diameter portion are continuous. The small diameter portion has a cylindrical shape. The small diameter portion has a parallel portion, and a pair of curved portions. The parallel portion is located at a center along an axial direction of the small diameter portion, and has a uniform diameter along the axial direction. Each curved portion is a portion connecting the parallel portion to the large diameter portion, and the diameter of each curved portion increases from the parallel portion toward the large diameter portion. A length of the test piece along the axial direction was 90.18 mm. A length of each large diameter portion along the axial direction was 27.5 mm, and a length of the small diameter portion along the axial direction was 35.18 mm. The diameter of the large diameter portion was 12 mm. The diameter of the parallel portion was 8 mm. A length of the parallel portion was 16 mm.

As the measurement conditions, the rotation speed was set at 3400 rpm. The maximum stress amplitude at which the test piece does not break when a reverse bend test is performed $10^7$ times was measured. The number N was assumed to be three. The average stress amplitude of the three test pieces was regarded as the stress amplitude of the sintered member. The results are illustrated in Table 1.

[Observations of Cross Sections]

The cross sections of the sample No. 1, the sample No. 2, the sample No. 101, and the sample No. 102 of the sintered member were observed.

The cross section of the sintered member was an arbitrary cross section. The cross section was exposed in the following manner. A resin compact was made by cutting a portion of the sintered member to obtain a sample piece, and embedding the sample piece in an epoxy resin to form a resin compact. A polishing process was performed on the resin compact. The polishing process was performed in two stages. In a first stage, the resin of the resin compact was polished until a cut surface of the sintered member becomes exposed. In a second stage, the exposed cut surface was polished. A mirror polishing was used for the polishing. In other words, the observed cross section was a mirror polished surface.

Figure 3A:
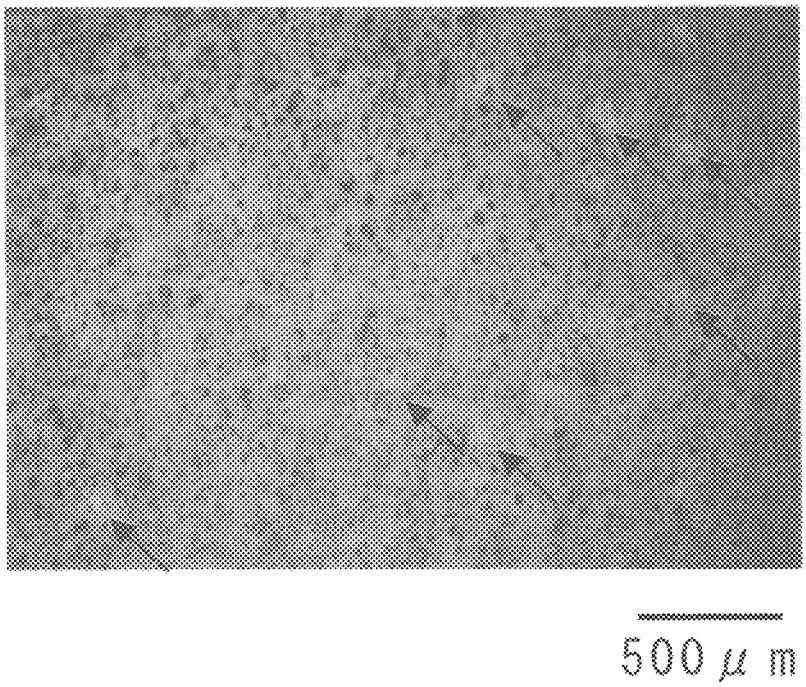
FIG. 3A is a microphotograph illustrating a cross section of a sintered member of a sample No. 1 according to one embodiment of the sintered member.
Figure 3B:
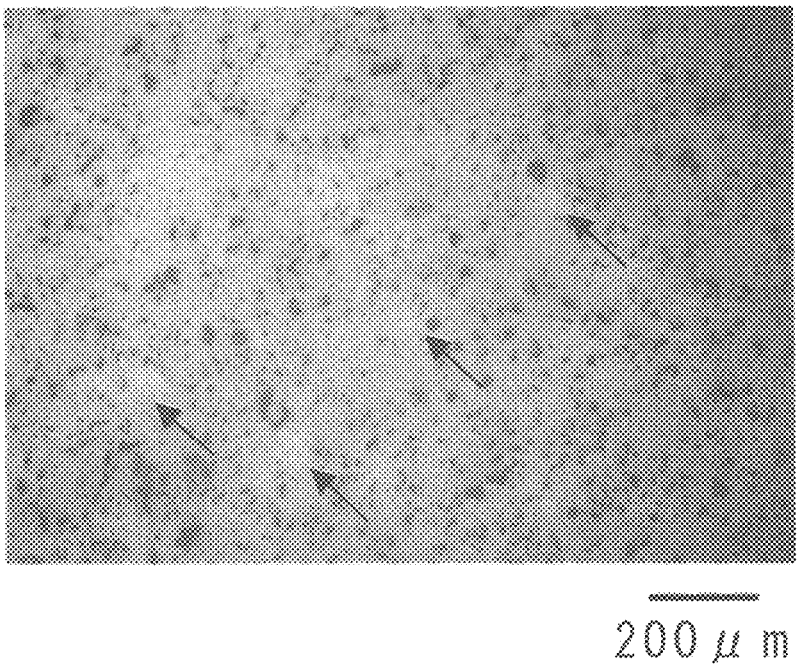
FIG. 3B is a microphotograph illustrating a cross section of the sintered member of the sample No. 1 according to one embodiment of the sintered member.
Figure 4A:
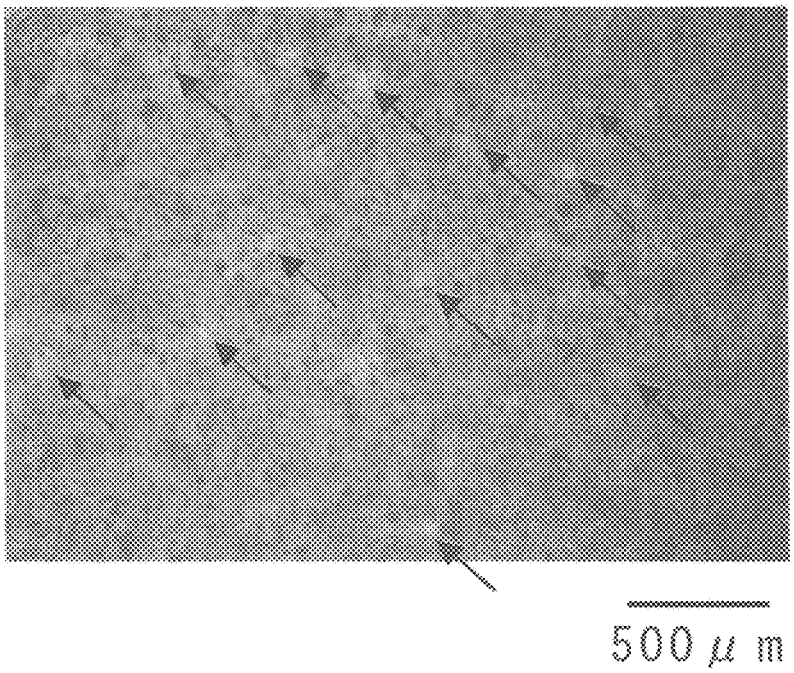
FIG. 4A is a microphotograph illustrating a cross section of the sintered member of the sample No. 2 according to one embodiment and the sintered member.
Figure 4B:
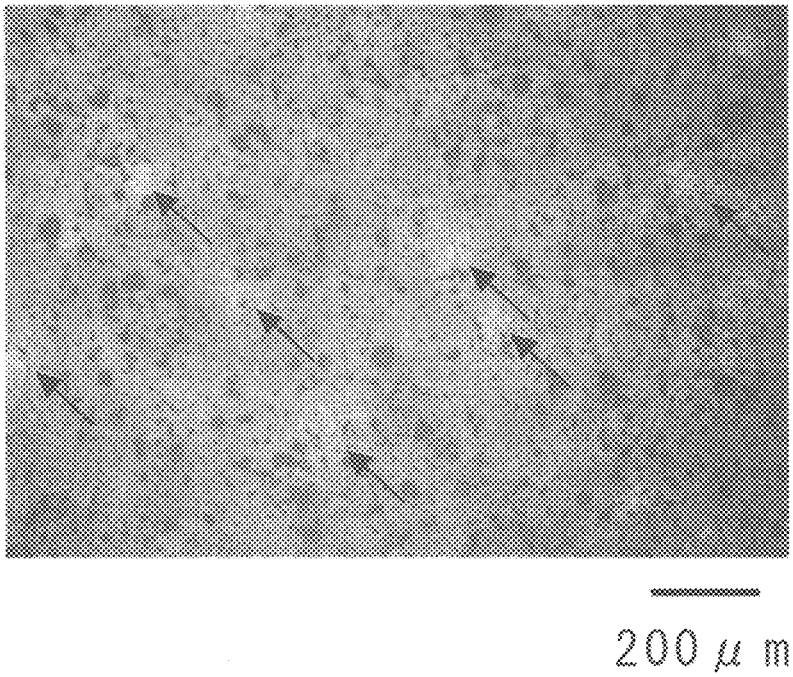
FIG. 4B is a microphotograph illustrating a cross section of the sintered member of the sample No. 2 according to one embodiment and the sintered member.

The cross section was observed using a light microscope GX51 manufactured by Olympus Corporation. FIG. 3A and FIG. 3B, FIG. 4A and FIG. 4B, FIG. 5, and FIG. 6 illustrate microphotographs of the cross sections of the sample No. 1, the sample No. 2, the sample No. 101, and the sample No. 102 of the sintered member, respectively. The size of the microphotographs of FIG. 3A, FIG. 4A, FIG. 5, and FIG. 6 is approximately 2.82 mm×2.09 mm. The size of the microphotographs of FIG. 3B and FIG. 4B is approximately 1.38 mm×1.02 mm.

Figure 5:
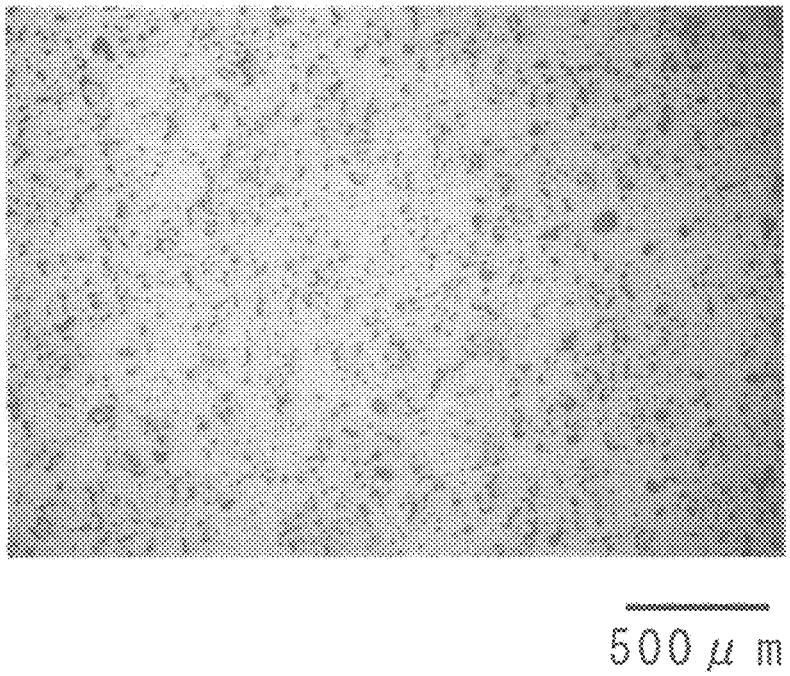
FIG. 5 is a microphotograph illustrating a cross section of the sintered member of the sample No. 101.

The presence or absence of the residual austenite phase in the four samples described above was determined from each of the microphotographs. For the sake of convenience, each of the microphotographs indicates the residual austenite phase by an arrow. The white portion at the tip end of the arrow indicates the residual austenite phase. A portion surrounding the white portion indicates the martensite phase. No arrow is illustrated in FIG. 5 because no residual austenite phase can be observed.

The area ratio the residual austenite phase in the five samples described above was determined. A portable X-ray residual stress measuring apparatus μ-X360 manufactured by Pulstec Industrial Co., Ltd. was used to determine a ratio of a total area of the residual austenite phase with respect to a total area of a measurement field of view. The number of measurement fields of view was two. The side of the measurement field of view was 2 mm in diameter. An average of the ratio of the total area of the residual austenite phase with respect to each of the measurement fields of view was regarded as the area ratio of the residual austenite phase. The results are illustrated in Table 1.

TABLE 1

| | Powder of raw material | | | | | | Sintered member | | | | |
|---|---|---|---|---|---|---|---|---|---|---|---|
| | Powder of iron-based alloy | | | | Ni | C | | Vickers hardness | | | Retained austenite phase |
| Sample No. | Cr Mass % | Cu Mass % | Mo Mass % | Ni Mass % | powder Mass % | powder Mass % | Density g/cm$^3$ | Average value HV | Variation width HV | Stress amplitude MPa | Area ratio % |
| 1 | 3.0 | — | 0.5 | — | 3 | 0.65 | 7.20 | 643 | 42 | 422 | 21 |
| 2 | 3.0 | — | 0.5 | — | 4 | 0.75 | 7.23 | 636 | 36 | 428 | 25 |
| 101 | 3.0 | — | 0.5 | — | 1 | 0.7 | 7.15 | 604 | 63 | 378 | 14 |
| 102 | 3.0 | — | 0.5 | — | 2 | 0.7 | 7.10 | 650 | 48 | 415 | 16 |
| 110 | — | 1.5 | 0.5 | 4 | — | 0.5 | 7.21 | 608 | 106 | 398 | 43 |

As illustrated in Table 1, the sample No. 1 and the sample No. 2 of the sintered member had a high Vickers hardness, a small variation width of the Vickers hardness, and a large stress amplitude. On the other hand, the sample No. 101 of the sintered member had a small variation width of the Vickers hardness, but a low Vickers hardness, and a small stress amplitude. The sample No. 102 of the sintered member had a high Vickers hardness, and a small variation width of the Vickers hardness, but a small stress amplitude. The sample No. 110 of the sintered member had a low Vickers hardness, a large variation width of the Vickers hardness, and a small stress amplitude.

Figure 6:
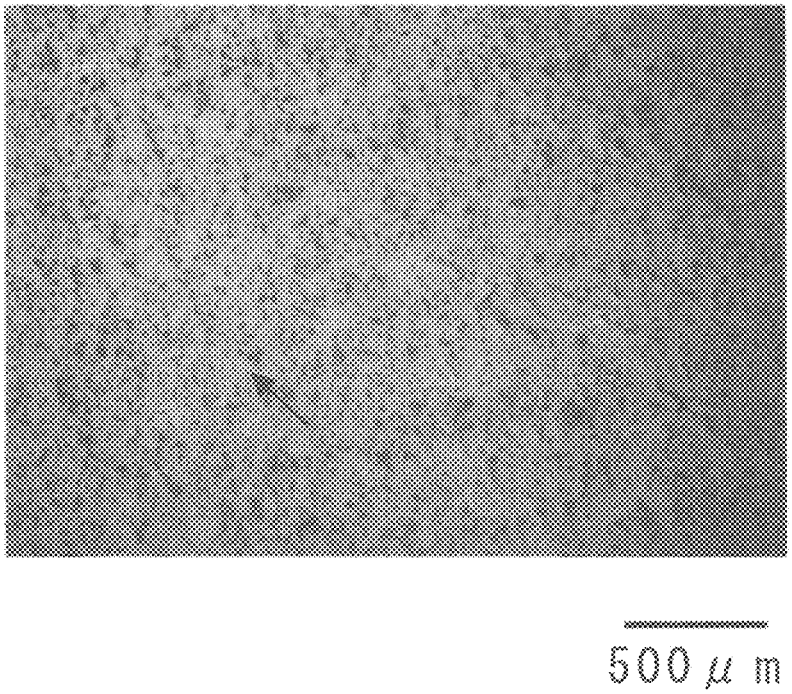
FIG. 6 is a microphotograph illustrating a cross section of a sintered member of a sample No. 102.

As illustrated in FIG. 3A, FIG. 3B, FIG. 4A, and FIG. 4B, the sample No. 1 and the sample No. 2 of the sintered member were found to have a mixed-phase composition of the martensite phase and the residual austenite phase. On the other hand, as illustrated in FIG. 5 and FIG. 6, the sample No. 101 and the sample No. 102 of the sintered member were found to be formed substantially of the martensite phase, including no or substantially no residual austenite phase. The area ratio of the residual austenite phase in the sample No. 1 and the sample No. 2 of the sintered member was high compared to the area ratio of the residual austenite phase in the sample No. 101 and the sample No. 102 of the sintered member.

The present invention is not limited to these examples, but it is intended to include all modifications within the meaning and scope of the claims and equivalents of the claims.

DESCRIPTION OF THE REFERENCE NUMERALS

1 Sintered member

The invention claimed is:

1. A sintered member including Fe as a main component thereof, comprising:

a composition including Ni, Cr, Mo, and C, and a remainder including Fe and inevitable impurities, and having a mixed-phase microstructure including a martensite phase and a residual austenite phase, wherein:

a Ni-content occupying the sintered member is larger than 2 mass % and smaller than or equal to 5.5 mass %, when a total content of elements included in the sintered member is regarded as 100 mass %, a Cr-content is larger than or equal to 2 mass % and smaller than or equal to 4 mass %, a Mo-content is larger than or equal to 0.2 mass % and smaller than or equal to 0.9 mass %, a C-content is larger than or equal to 0.2 mass % and smaller than or equal to 1.0 mass %, an area ratio of the residual austenite phase in a cross section of the sintered member is greater than or equal to 5% and less than or equal to 50%, a Vickers hardness at multiple locations between a surface and a predetermined depth of 5 mm in the cross section of the sintered member has a variation width of less than or equal to 100 HV, the Vickers hardness of the sintered member is defined as an average of Vickers hardness values measured at the multiple locations between the surface and the predetermined depth in the cross section of the sintered member, and the variation width of the Vickers hardness of the sintered member is defined as a difference between a maximum value and a minimum value of the Vickers hardness values measured between the surface and the predetermined depth in the cross section of the sintered member.

2. The sintered member as claimed in claim 1, wherein a stress amplitude withstanding a reverse bend test performed $10^7$ times during a rotating bending fatigue test is greater than or equal to 420 MPa.

3. The sintered member as claimed in claim 1, wherein the Ni-content occupying the sintered member is larger than or equal to 2.5 mass % and smaller than or equal to 5.5 mass %.

4. The sintered member as claimed in claim 1, wherein the Ni-content occupying the sintered member is larger than or equal to 3 mass % and smaller than or equal to 5 mass %.

5. A sintered member including Fe as a main component thereof, comprising:

a composition including Ni, Cr, Mo, and C, and a remainder including Fe and inevitable impurities, wherein:

a Ni-content occupying the sintered member is larger than 2 mass % and smaller than or equal to 5.5 mass %, when a total content of elements included in the sintered member is regarded as 100 mass %, a Cr-content is larger than or equal to 2 mass % and smaller than or equal to 4 mass %, a Mo-content is larger than or equal to 0.2 mass % and smaller than or equal to 0.9 mass %, a C-content is larger than or equal to 0.2 mass % and smaller than or equal to 1.0 mass %, the sintered member is formed by pressure molding a green compact from the composition, and sintering followed by rapid cooling, causing the sintered member to exhibit:

a mixed-phase microstructure including a martensite phase and a residual austenite phase, and a Vickers hardness at multiple locations between a surface and a predetermined depth of 5 mm in a cross section of the sintered member with a variation width of less than or equal to 100 HV, wherein:

the Vickers hardness of the sintered member is defined as an average of Vickers hardness values measured at the multiple locations between the surface and the predetermined depth in the cross section of the sintered member, the variation width of the Vickers hardness of the sintered member is defined as a difference between a maximum value and a minimum value of the Vickers hardness values measured between the surface and the predetermined depth in the cross section of the sintered member, and the green compact after the sintering and the rapid cooling causes the sintered member to exhibit an area ratio of the residual austenite phase in the cross section of the sintered member greater than or equal to 5% and less than or equal to 50%.

6. The sintered member as claimed in claim 5, wherein the green compact after the sintering and the rapid cooling causing the sintered member to exhibit a stress amplitude withstanding a reverse bend test performed $10^7$ times during a rotating bending fatigue test greater than or equal to 420 MPa.

7. The sintered member as claimed in claim 5, wherein the Ni-content occupying the sintered member is larger than or equal to 2.5 mass % and smaller than or equal to 5.5 mass %.

8. The sintered member as claimed in claim 5, wherein the Ni-content occupying the sintered member is larger than or equal to 3 mass % and smaller than or equal to 5 mass %.

* * * * *